US008181964B2

(12) United States Patent
Ritter et al.

(10) Patent No.: US 8,181,964 B2
(45) Date of Patent: May 22, 2012

(54) GAME

(75) Inventors: Janice E. Ritter, Redondo Beach, CA (US); Damon R. Saddler, Inglewood, CA (US)

(73) Assignee: Mattel, Inc., El Segundo, CA (US)

( * ) Notice: Subject to any disclaimer, the term of this patent is extended or adjusted under 35 U.S.C. 154(b) by 176 days.

(21) Appl. No.: 12/766,421

(22) Filed: Apr. 23, 2010

(65) Prior Publication Data

US 2011/0260408 A1 Oct. 27, 2011

(51) Int. Cl.
*A63F 9/00* (2006.01)

(52) U.S. Cl. ..... 273/445

(58) Field of Classification Search ..... 273/440, 273/445, 447, 108, 118 R, 109
See application file for complete search history.

(56) References Cited

U.S. PATENT DOCUMENTS

| | | | | |
|---|---|---|---|---|
| 1,169,257 | A | | 1/1916 | Heep |
| 1,473,603 | A | | 11/1923 | Anderson |
| 2,622,366 | A | | 12/1952 | Abplanalp |
| 2,756,054 | A | | 7/1956 | Strohm |
| 3,053,538 | A | | 9/1962 | Roca |
| 3,545,750 | A | | 12/1970 | Stachnik, Sr. |
| 3,628,792 | A | | 12/1971 | Frederick et al. |
| 3,721,440 | A | | 3/1973 | Burns |
| 4,061,334 | A | * | 12/1977 | Kanno ..... 273/126 A |
| 4,119,312 | A | * | 10/1978 | Todokoro ..... 273/447 |
| 4,157,183 | A | | 6/1979 | Meyer et al. |
| 4,200,284 | A | | 4/1980 | Kaga |
| 4,214,750 | A | | 7/1980 | Shimizu |
| 4,224,761 | A | | 9/1980 | Wakimura |
| 4,229,003 | A | * | 10/1980 | Shimizu ..... 273/448 |
| 4,266,767 | A | * | 5/1981 | Spring ..... 273/447 |
| 4,272,075 | A | | 6/1981 | Rogers, Jr. |
| 4,298,199 | A | | 11/1981 | Bush et al. |
| 4,306,717 | A | | 12/1981 | Todokoro |
| 4,412,682 | A | | 11/1983 | Rehkemper et al. |
| 4,432,544 | A | | 2/1984 | Wakimura |
| 4,469,327 | A | | 9/1984 | Ulrich et al. |
| 4,603,860 | A | | 8/1986 | Wey |
| 4,714,249 | A | * | 12/1987 | Barlow ..... 273/447 |
| 4,749,195 | A | | 6/1988 | Lee |
| 4,778,176 | A | * | 10/1988 | Shoemaker, Jr. ..... 273/448 |
| 4,778,433 | A | | 10/1988 | McKay et al. |
| 4,783,076 | A | | 11/1988 | Lee |
| 4,790,532 | A | | 12/1988 | Chen |
| 4,802,668 | A | | 2/1989 | Kobayashi |
| 4,813,670 | A | | 3/1989 | Mizunuma |

(Continued)

FOREIGN PATENT DOCUMENTS

GB 2033762 A * 5/1980

(Continued)

*Primary Examiner* — Raleigh W. Chiu
(74) *Attorney, Agent, or Firm* — Cantor Colburn LLP

(57) ABSTRACT

A game apparatus and method of playing a game is disclosed herein. The game apparatus having: a central area that is configured to be rotated in a first direction; an outer member surrounding the central area, the outer member being configured to be rotated in a second direction, the second direction being opposite to the first direction; a wall member separating an outer periphery of the central area from an inner periphery of the outer member; and a plurality of grabbing devices disposed about the outer member, each of the plurality of grabbing devices being configured to grab an object from the outer member and move it to the central area by tossing it over the wall member.

20 Claims, 3 Drawing Sheets

U.S. PATENT DOCUMENTS 4,826,160 A 5/1989 Kobayashi
4,838,553 A 6/1989 Chaun-Tien
4,863,164 A 9/1989 Mizunuma
4,880,231 A 11/1989 Kobayashi
4,900,026 A * 2/1990 Kulesza et al. ..... 273/119 A
4,936,574 A * 6/1990 Lee ..... 273/447
4,957,287 A 9/1990 Kobayashi
4,961,580 A 10/1990 Yoe et al.
4,961,716 A 10/1990 Hippely et al.
5,009,418 A 4/1991 Chuan-Tien
5,028,047 A 7/1991 Lee et al.
5,050,876 A 9/1991 Chuang
5,102,148 A 4/1992 Mizunuma
5,193,819 A 3/1993 Chen
5,207,793 A * 5/1993 Brand et al. ..... 273/445
5,271,628 A * 12/1993 Okada ..... 273/448
5,342,064 A * 8/1994 Williamson et al. ..... 273/447
5,609,340 A 3/1997 Chuang
5,609,341 A 3/1997 Chuang
5,653,446 A 8/1997 Lin
5,702,108 A * 12/1997 Todokoro ..... 273/447
5,752,704 A 5/1998 Todokoro
5,855,374 A * 1/1999 Shoemaker, Jr. ..... 273/447
5,887,872 A 3/1999 Keifer et al.
6,164,653 A 12/2000 Chuang
6,454,261 B2 9/2002 Ohira
6,537,124 B2 3/2003 Todokoro
6,550,774 B1 4/2003 Stroll et al.
6,634,940 B2 10/2003 Yoshida et al.
6,789,798 B1 9/2004 Adams et al.
6,994,556 B2 2/2006 Au
2001/0048194 A1 12/2001 Ohira
2006/0290065 A1 12/2006 Blagg et al.

FOREIGN PATENT DOCUMENTS

JP 2001062139 A 3/2001
JP 2004358121 A 12/2004

* cited by examiner

GAME

BACKGROUND

Various exemplary embodiments of the present invention are related to a game and method of playing the game.

Games involving skill and/or luck have been popular for many years. The winner of some games is determined by having each of the players try to accumulate a predetermined amount of objects in a predetermined amount of time or when all of the objects have been accumulated.

Accordingly, it is desirable to provide a game wherein the outcome may be out of the control of those who are playing it to add enhance play features to the game.

SUMMARY OF THE INVENTION

In one embodiment, a game apparatus is disclosed herein. The game apparatus having: a central area that is configured to be rotated in a first direction; an outer member surrounding the central area, the outer member being configured to be rotated in a second direction, the second direction being opposite to the first direction; a wall member separating an outer periphery of the central area from an inner periphery of the outer member; and a plurality of grabbing devices disposed about the outer member, each of the plurality of grabbing devices being configured to grab an object from the outer member and move it to the central area by tossing it over the wall member.

In another embodiment a game apparatus is disclosed herein. The game apparatus having: a base structure; a central area rotatably secured to the base structure for rotation in a first direction; an outer member rotatably secured to the base structure for rotation in a second direction, the second direction being opposite to the first direction, and wherein the outer member surrounds the central area; a wall member separating an outer periphery of the central area from an inner periphery of the outer member; a plurality of objects configured to be received on the outer member; and a plurality of grabbing devices secured to the base structure and surrounding the outer member, each of the plurality of grabbing devices being configured to grab at least one of the plurality of objects from the outer member and move it to the central area by tossing it over the wall member.

In another exemplary embodiment, a method for playing a game is disclosed herein, the method including the steps of: rotating a central area about an axis of a base structure in a first direction; rotating an outer member about the axis in a second direction, the second direction being opposite to the first direction, wherein the outer member surrounds the central area; surrounding the central area with a wall member disposed between the central area and outer member; biasing the central area upwardly in a direction parallel to the first axis, wherein the central area is configured to move up and down with respect to the first axis between a first position and a second position, wherein the height of the wall member with respect to a surface of the central area is reduced as the central area is moved from the first position to the second position; operating a plurality of grabbing devices secured to the base structure and surrounding the outer member, each of the plurality of grabbing devices being configured to grab at least one of a plurality of objects configured to be received on the outer member and move it to the central area by tossing it over the wall member, wherein the plurality of objects also comprise a plurality of sub sets each having a matching configuration or indicia that differentiates one of the plurality of sub sets from another one of the plurality of sub sets; retaining the central area in the first position until a predetermined time period has elapsed; releasing the central area from the first position after the predetermined time period has elapsed, wherein the central area moves from the first position to the second position, wherein movement of the central area from the first position to the second position is sufficient to launch anyone of the plurality of objects from the central area over the wall member and towards the outer member; and determining a winner of the game by calculating the greatest number of objects corresponding to one of the plurality of sub-sets that is retained in the central area after the predetermined time period has elapsed.

DETAILED DESCRIPTION

Figure 1:
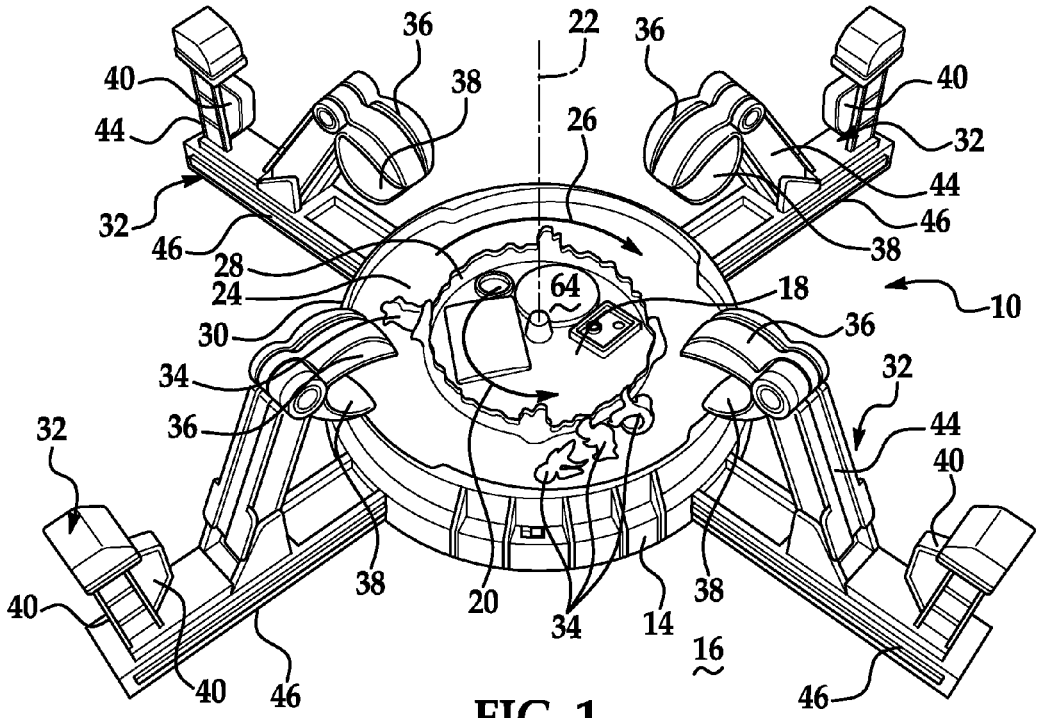
FIGS. 1 and 2 are perspective views of a game apparatus in accordance with an exemplary embodiment of the present invention.

Referring now to the FIGS. and in accordance with exemplary embodiments of the present invention a game apparatus 10 for playing a game is disclosed herein. The game apparatus has a base structure 12 for supporting the game apparatus on a surface 16. Rotatably secured to the base structure is a central area 18. In one embodiment, the central area rotates in a first direction illustrated by arrow 20 about an axis 22 of the game apparatus.

Also rotatably secured to the base structure is an outer member 24. Outer member 24 surrounds the central area and in one embodiment rotates in a second direction illustrated by arrow 26, the second direction being opposite to the first direction. Although arrows 20 and 26 illustrate specific opposite directions in the FIGS. it is, of course, understood that the first and second directions may be the same or opposite to those illustrated in the FIGS. In addition and if the first and second directions are the same they may be rotated at different or the same speed with respect to each other. In one embodiment, the central area and the outer member are rotated by a motor.

Separating the central area from the outer member is a wall member 28. Wall member 28 separates an outer periphery of the central area from an inner periphery of the outer member. Also illustrated in the FIGS. is an outer wall member 30 that is located proximate to an outer periphery of the outer member. Here outer wall member 30 will comprise a portion of the base structure.

In one non-limiting embodiment, the wall member is configured to surround the central area and the wall member has varying height with respect to a surface of the outer member. In addition and in alternative embodiment, the wall member is configured to rotate with either the central area or the outer member.

Located about the base structure is a plurality of grabbing devices 32. Each of the plurality of grabbing devices are configured to grab at least one of a plurality of objects 34 from the outer member as they rotate or move past one of the grabbing devices. Each grabbing device is configured such that objects grabbed by the grabbing devices can be moved to the central area by tossing them over the wall member.

In one non-limiting exemplary embodiment of the present invention, there are four grabbing devices disposed about the game apparatus and there are 16 objects with four sub-sets of four each. In other words, there are 4 objects for each of the corresponding grabbing devices. Of course, the number and amount of objects and grabbing devices may vary to be greater or less than the numbers previously mentioned.

Each of the sub-sets having a matching configuration or indicia (e.g., color, pattern or other marking) that differentiates one of the plurality of sub sets from another one of the plurality of sub sets. For example and in one non-limiting embodiment, there are four yellow objects, four blue objects, four green objects and four red objects. Of course, numerous other configurations and colors are considered to be within the scope of exemplary embodiments of the present invention.

Figure 2:
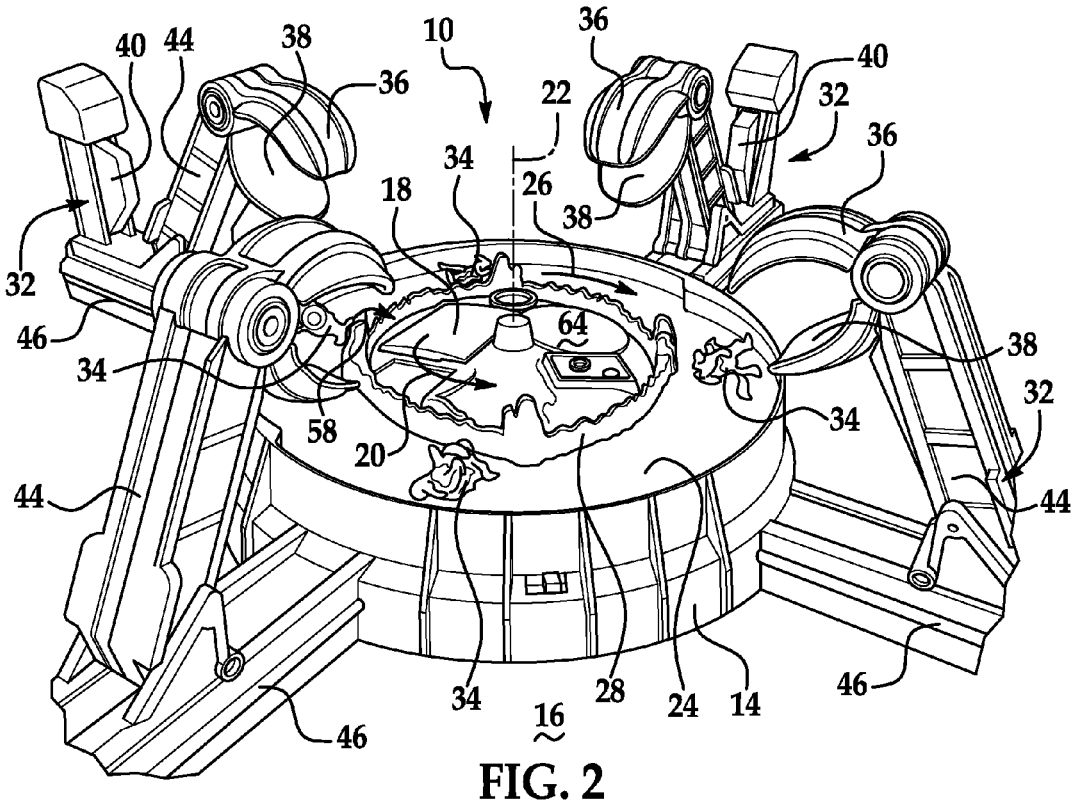
Figure 3:
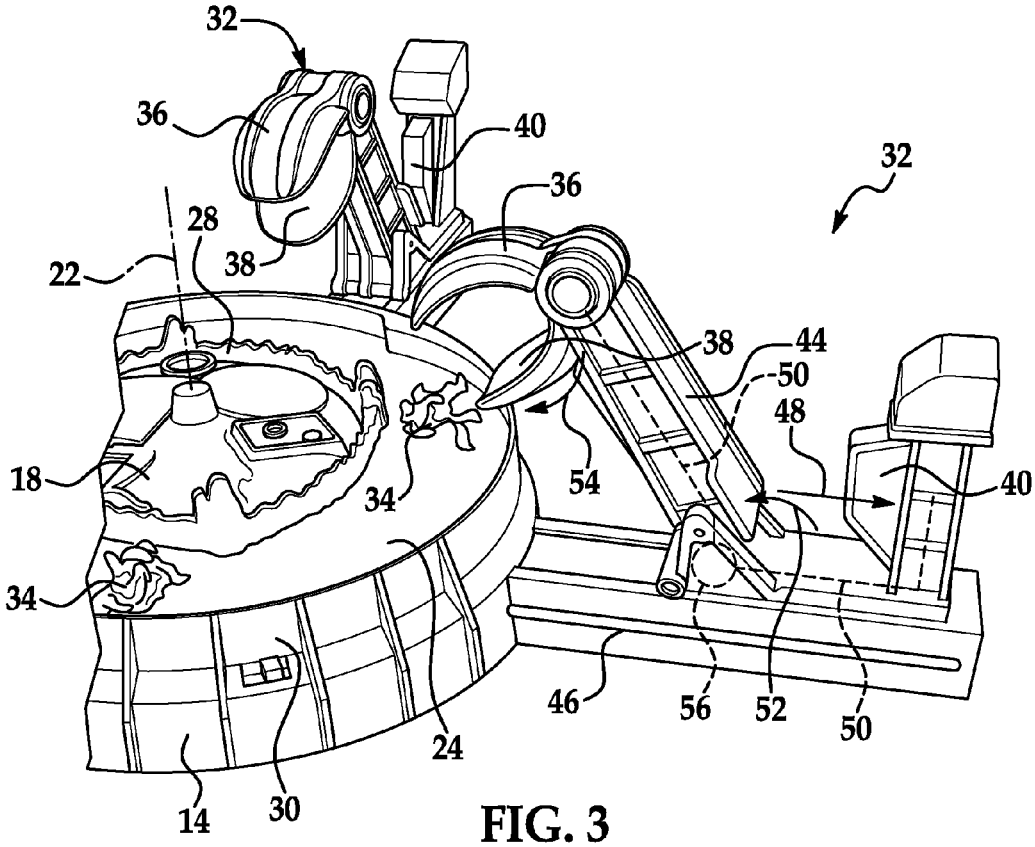
FIG. 3 is a perspective view illustrating a grabbing mechanism of the game apparatus of an exemplary embodiment of the present invention in a first position.

In accordance with various embodiments of the present invention, the objects may be theme or character related in that each object is a character or is representative of a story line in a book, movie, play, television show or any other form of media. Furthermore the game apparatus and each grabbing device may be similar to a corresponding scene for the story line, book, movie, play, etc. For example and in one non-limiting embodiment and as illustrated in the FIGS. 1 and 2, the grabbing devices represent claws and the outer member is a conveyor belt and the central area is a garbage dump.

In one non-limiting embodiment, each of the grabbing devices has a pair of jaw members 36, 38. In addition, each of the plurality of grabbing devices are configured for movement between a first position (FIGS. 1-3) and a second position (FIGS. 4 and 5), wherein at least one of the pair of jaw members of the grabbing device moves towards the other one of the pair of jaw members as the grabbing device moves from the first position towards the second position and wherein at least one of the pair of jaw members of each of the plurality of grabbing devices moves away from the other one of the pair of jaw members as the grabbing device moves from the second position towards the first position (See FIGS. 1-5). Furthermore and as illustrated in the FIGS., the pair of jaw members of the grabbing devices move towards the outer member when they are moved from the first position to the second position. Although FIGS. 1-5 illustrate the grabbing devices as having jaw members that open and close other equivalent structures are considered to be within the scope of exemplary embodiments of the present invention.

In order to manipulate the grabbing devices towards the outer member a trigger 40 is positioned to be depressed by a game player's hand 42 for movement of the grabbing device from the first position to the second position.

Figure 4:
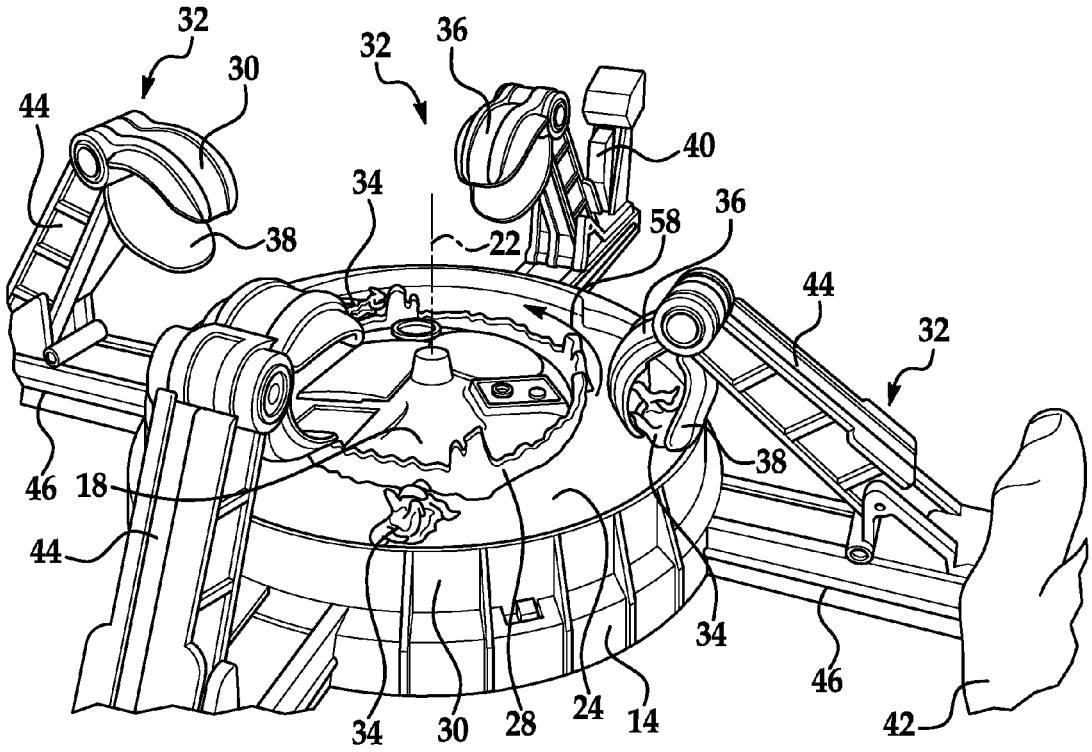
FIG. 4 is a perspective view illustrating a grabbing mechanism of the game apparatus of an exemplary embodiment of the present invention in a second position, wherein an object is being grabbed by the grabbing mechanism.
Figure 5:
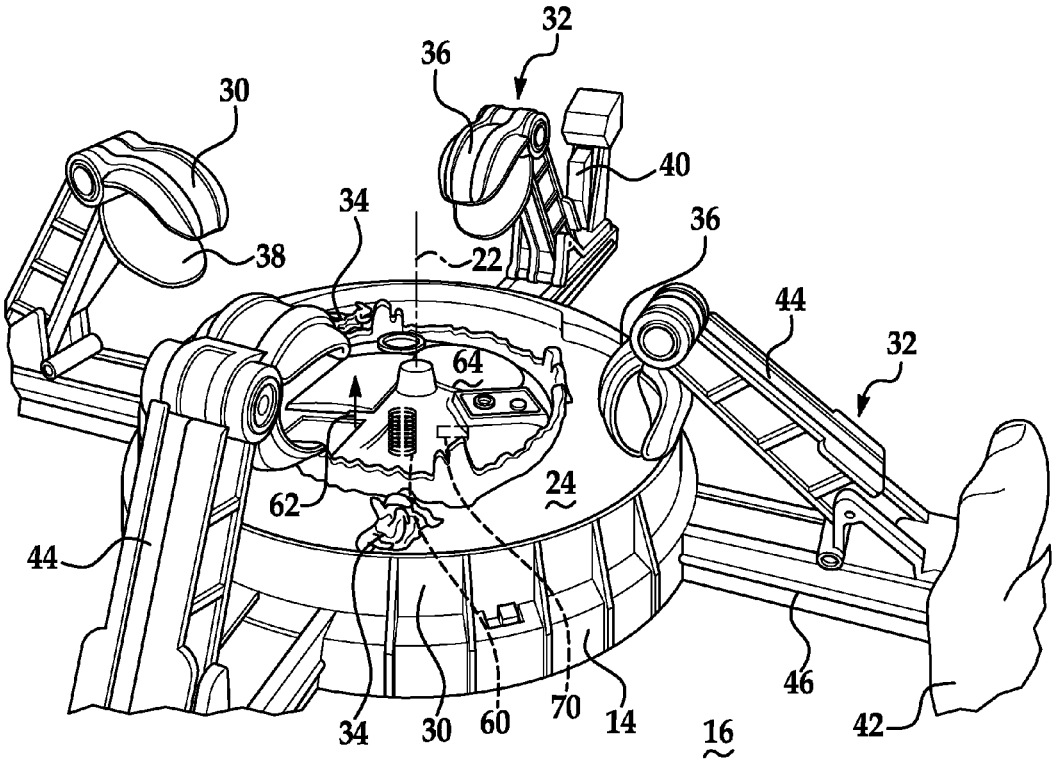
FIG. 5 is a perspective view illustrating a grabbing mechanism of the game apparatus of an exemplary embodiment of the present invention in a second position.

As illustrated, each grabbing device has an arm member 44 pivotally mounted to a bottom portion 46 at one end and the pair of jaw members are located at an opposite end of the arm member, wherein at least one of the jaw members is pivotally mounted to the arm member. Referring now to FIGS. 4 and 5 and in order to move the grabbing device from the first position to the second position, a user depresses a trigger in the direction of arrow 48. Trigger 40 is coupled to a linkage 50 disposed within the grabbing device such that depression of trigger 40 will cause arm member 44 to rotate in the direction of arrow 52 at the point of its pivotal securement to the bottom portion, which in turn causes the pair of jaw members 36 and 38 to move towards the outer member. In addition and as the jaw members move towards the outer member, the linkage 50 also causes the lower jaw member 38 to pivot or rotate towards the upper jaw member 36 by pivoting in the direction of arrow 54 to move the jaw members from the open position (FIGS. 1-3) to a closed position (FIGS. 4 and 5). Moreover and if an object 34 is on the outer member when the grabbing device moves to the second position it will be grabbed by the jaw members (See FIG. 4).

In order to move the grabbing device back to the first position the user simply releases trigger 40 and a spring 56 that provides a biasing force in a direction opposite to arrow 52 will cause the grabbing device, the linkage and jaw member 38 to move back to that corresponding to the first position of the grabbing device wherein an object if retained in the pair of jaw members at the second position of the grabbing device will be tossed in the direction of arrow 58 over wall member 28 and into the central area 18.

Accordingly, the repetitive manipulation of the trigger in and out will cause the grabbing device to move back and forth between the first position and the second position. In addition and if an object is in the correct location (e.g., on the rotating outer member in front of the grabbing device) it will be captured and tossed into the central area. Furthermore and as discussed above, each of the sub-sets will correspond to a player manipulating the grabbing device and the object of the game will be to move all of your corresponding objects into the central area or alternatively all of your opponents objects into the central area.

Although one specific grabbing mechanism is illustrated, numerous alternative configurations and equivalent structures known to those skilled in the related art are considered to be within the scope of exemplary embodiments of the present invention.

As discussed above, the outer member and the central area are configured to rotate about the first axis and in one exemplary embodiment, the central area is also configured to move up and down with respect to the first axis between a first position and a second position, wherein the height of the wall member with respect to a surface of the central area is reduced as the central area moved from the first position to the second position. In order to achieve this motion of the central member upward from the first position to the second position the central area is slidably received within the wall member for movement parallel to axis 22 and a spring 60 is positioned in the structure and provide a biasing force in the direction of arrow 62 to a bottom surface of the central area such that the central member is always biased upwardly.

In accordance with an exemplary embodiment of the present invention and in order to retain the central area in the first position a user simply applies a force to a surface 64 of the central area in a direction opposite to arrow 62 until a releasable catch 70 engages a portion of the central area and retains it in the first position wherein spring 60 is now in a compressed state such that potential energy or a force is stored and ready to push the central area upward in the direction of arrow 62 and towards the second position wherein a distance between the surface 64 of the central area and a top portion of the wall is reduced.

During game play the central area is pushed down and retained in the first position with spring 60 compressed until the releasable catch is released and the central area "pops" up. In addition and as the central area moves or "pops" upward objects on surface 64 may be tossed back over the wall portion onto the outer member.

Accordingly, the popping up of the central area may work against the players of the game. Release of the releasable catch or release mechanism may be dependent upon a timer, either mechanical or electrical, that causes the mechanism to release the engaged portion of the central area and allow the spring to move the central area upward. An electrical timer may be dependent upon a clock, capacitor, microprocessor or other equivalent device that begins a countdown after the central area is depressed and the game is turned on (e.g., power supplied to game to operate the motor). Alternatively or in addition to the electronic timer, a mechanical timer may be employed that is spring dependent or releases the release mechanism after a predetermined amount of revolutions of the central area or the outer member or alternatively a predetermined number of trigger depressions.

Figure 6:
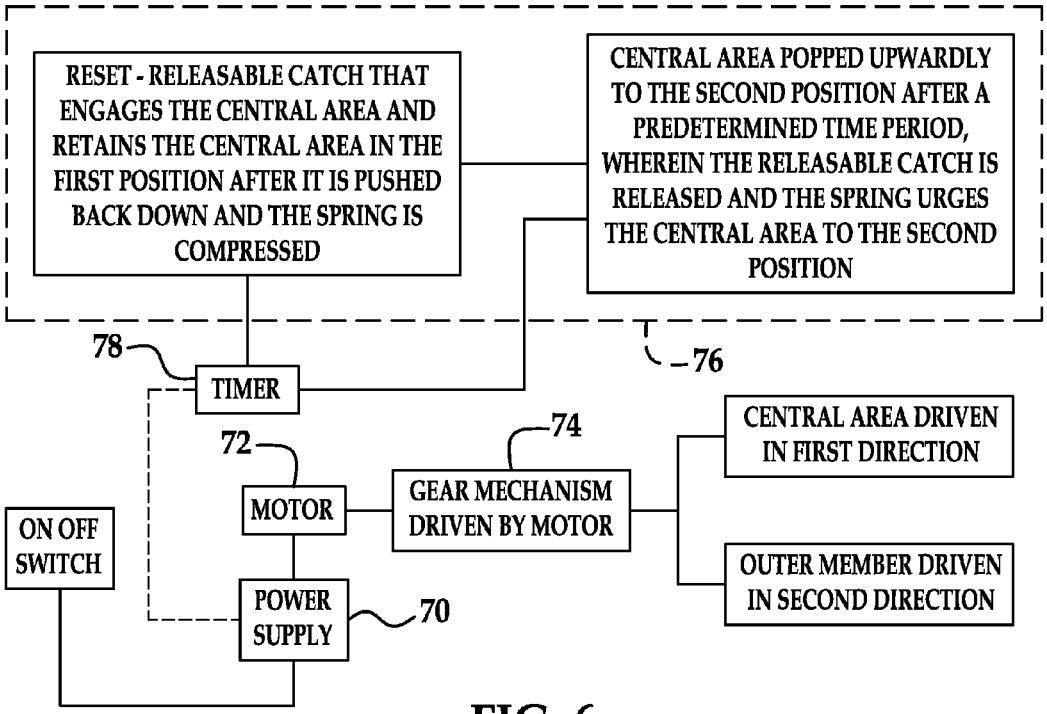
FIG. 6 is a schematic illustration of an exemplary embodiment of the present invention.

FIG. 6 provides a schematic illustration of a portion of the game wherein a power supply 70 (e.g., battery or direct DC or AC current) is applied to a motor 72 for rotating a gear mechanism 74 that rotates the central area and the outer member. A releasable mechanism 76 engages and retains the central area in the first position until a timer mechanism 78 has determined a predetermined amount of time has elapsed while the outer member and the central area rotate about the first axis. Once the predetermined amount of time has elapsed the timer will cause the releasable mechanism to be released and the potential energy of the spring biasing force against the central area will be released and the central area will "pop up". As discussed, above the movement of the central area from the first position to the second position is sufficient to launch an object from the central area over the wall member and towards the outer member.

As shown schematically in FIG. 6, the releasable mechanism is capable of being reset by depressing the central area downward until the releasable catch is once again engaged. Alternatively, the central area and the releasable mechanism may be automatically configured to mechanically depress the central area, engage the releasable mechanism and then subsequently release the central area and repeat this process until to the central area "pops up" one last and final time.

Game apparatus 10 allows multiple players to play game comprising the following features or steps: placing a plurality of objects on an outer member of the game and rotating the central area about an axis of the base structure in a first direction, while simultaneously rotating the outer member about the axis in a second direction, the second direction being opposite to the first direction and the outer member surrounds the central area. Thereafter each of the players operates their grabbing mechanism to try and toss their corresponding objects from the outer member onto the central area by passing them over a wall member disposed between the central area and outer member.

In addition and as an added step to this game, the central area is configured to move up and down with respect to the first axis between a first position and a second position, wherein the height of the wall member with respect to a surface of the central area is reduced as the central area is moved from the first position to the second position. This movement or popping up of the central area will occur at predetermined time periods and cause some objects on the central area to be thrown back over the wall member onto the outer member. The winner of the game is determined when the central area pops up for the last time and the pieces on the central area after this one last "pop up" will determine a winner of the game.

Thus in one embodiment the object of the game is to the first player to rescue the most of their characters from the outer member and drop them into the central area. The player with the most characters in the central area after the final "pop" wins.

The game is setup by loading all of the characters or objects onto outer member and each player chooses his/her corresponding grabbing device. Then, with all players in position, one player pushes down the central area and turns the game on with the on/off switch. Then all of the characters or objects begin travelling around the outer member.

Each player then begins to try and grab their chosen character or object color from the outer member by pulling the trigger on their grabbing device to pick up an object, and releasing the trigger quickly to flip the object into the central area.

As discussed above, the central area will randomly "pop up" and eject some of the objects back onto the outer member. The game ends when the central area makes one last "pop" and releases characters back onto the outer member. The player with the most objects remaining in the central area wins the game.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A game apparatus, comprising:

a central area that is configured to be rotated in a first direction;

an outer member surrounding the central area, the outer member being configured to be rotated in a second direction, the second direction being opposite to the first direction;

a wall member separating an outer periphery of the central area from an inner periphery of the outer member; and a plurality of grabbing devices disposed about the outer member, each of the plurality of grabbing devices being configured to grab an object from the outer member and move it to the central area by tossing it over the wall member.

2. The game apparatus as in claim 1, wherein each of the plurality of grabbing devices are configured for movement between a first position and a second position, wherein each of the plurality of grabbing devices has a pair of jaw members and wherein at least one of the pair of jaw members of each of the plurality of grabbing devices moves towards the other one of the pair of jaw members as the grabbing device moves from the first position towards the second position, and wherein at least one of the pair of jaw members of each of the plurality of grabbing devices moves away from the other one of the pair of jaw members as the grabbing device moves from the second position towards the first position.

3. The game apparatus as in claim 2, wherein the pair of jaw members of each of the plurality of grabbing devices is moved towards the outer member when they are moved from the first position to the second position.

4. The game apparatus as in claim 3, wherein each of plurality of grabbing devices are manually operated by a trigger for movement from the first position to the second position.

5. The game apparatus as in claim 1, wherein the outer member and the central area are configured to rotate about a first axis and wherein the central area is also configured to move up and down with respect to the first axis between a first position and a second position, wherein the height of the wall member with respect to a surface of the central area is reduced as the central area moved from the first position to the second position.

6. The game apparatus as in claim 5, wherein the central area is spring biased towards the second position and a releasable mechanism retains the central area in the first position until a timer mechanism has determined a predetermined amount of time has elapsed while the outer member and the central area rotate about the first axis.

7. The game apparatus as in claim 6, wherein movement of the central area from the first position to the second position is sufficient to launch the object from the central area over the wall member and towards the outer member.

8. The game apparatus as in claim 1, wherein the wall member is configured to surround the central area and the wall member has varying height with respect to the outer member.

9. The game apparatus as in claim 8, wherein the wall member is configured to be rotated with either the central area or the outer member.

10. The game apparatus as in claim 1, wherein the central area and the outer member are each rotated by a gear mechanism driven by a motor.

11. A game apparatus, comprising:

a base structure;

a central area rotatably secured to the base structure for rotation in a first direction;

an outer member rotatably secured to the base structure for rotation in a second direction, the second direction being opposite to the first direction, and wherein the outer member surrounds the central area;

a wall member separating an outer periphery of the central area from an inner periphery of the outer member;

a plurality of objects configured to be received on the outer member; and a plurality of grabbing devices secured to the base structure and surrounding the outer member, each of the plurality of grabbing devices being configured to grab at least one of the plurality of objects from the outer member and move it to the central area by tossing it over the wall member.

12. The game apparatus as in claim 11, wherein the outer member and the central area are configured to rotate about a first axis and wherein the central area is also configured to move up and down with respect to the first axis between a first position and a second position, wherein the height of the wall member with respect to a surface of the central area is reduced as the central area moved from the first position to the second position.

13. The game apparatus as in claim 12, wherein the central area is spring biased towards the second position and a releasable mechanism retains the central area in the first position until a timer mechanism has determined a predetermined amount of time has elapsed while the outer member and the central area rotate about the first axis and wherein movement of the central area from the first position to the second position is sufficient to launch anyone of the plurality of objects from the central area over the wall member and towards the outer member.

14. The game apparatus as in claim 13, wherein the wall member is configured to surround the central area and the wall member has a varying height with respect to the outer member and wherein the wall member is configured to be rotated with either the central area or the outer member.

15. The game apparatus as in claim 13, wherein the central area and the outer member are each rotated by a gear mechanism driven by a motor.

16. The game apparatus as in claim 11, wherein the wall member is configured to be rotated with either the central area or the outer member.

17. The game apparatus as in claim 11, wherein each of the plurality of grabbing devices are configured for movement between a first position and a second position, wherein each of the plurality of grabbing devices has a pair of jaw members and wherein at least one of the pair of jaw members of each of the plurality of grabbing devices moves towards the other one of the pair of jaw members as the grabbing device moves from the first position towards the second position, and wherein at least one of the pair of jaw members of each of the plurality of grabbing devices moves away from the other one of the pair of jaw members as the grabbing device moves from the second position towards the first position, wherein the pair of jaw members of each of the plurality of grabbing devices is moved towards the outer member when they are moved from the first position to the second position and wherein each of plurality of grabbing devices are manually operated by a trigger for movement from the first position to the second position.

18. The game apparatus as in claim 17, wherein each of plurality of grabbing devices are manually operated by a trigger for movement from the first position to the second position and the plurality of objects comprise a plurality of sub sets each having a matching configuration or indicia that differentiates one of the plurality of sub sets from another one of the plurality of sub sets.

19. A method of playing a game, the method comprising:

rotating a central area about an axis of a base structure in a first direction;

rotating an outer member about the axis in a second direction, the second direction being opposite to the first direction, wherein the outer member surrounds the central area;

surrounding the central area with a wall member disposed between the central area and outer member;

biasing the central area upwardly in a direction parallel to the first axis, wherein the central area is configured to move up and down with respect to the first axis between a first position and a second position, wherein the height of the wall member with respect to a surface of the central area is reduced as the central area is moved from the first position to the second position;

operating a plurality of grabbing devices secured to the base structure and surrounding the outer member, each of the plurality of grabbing devices being configured to grab at least one of a plurality of objects configured to be received on the outer member and move it to the central area by tossing it over the wall member, wherein the plurality of objects also comprise a plurality of sub sets each having a matching configuration or indicia that differentiates one of the plurality of sub sets from another one of the plurality of sub sets;

retaining the central area in the first position until a predetermined time period has elapsed;

releasing the central area from the first position after the predetermined time period has elapsed, wherein the central area moves from the first position to the second position, wherein movement of the central area from the first position to the second position is sufficient to launch anyone of the plurality of objects from the central area over the wall member and towards the outer member; and determining a winner of the game by calculating the greatest number of objects corresponding to one of the plurality of sub-sets that is retained in the central area after the predetermined time period has elapsed.

20. The method as in claim 19, further comprising resetting the central area to the first position and subsequently releasing the central area from the first position after the predetermined time period has elapsed, wherein the step of determining the winner of the game is not performed until central area has been released a predetermined amount of times or the game has been played for a predetermined amount of playing time, the predetermined amount of playing time being greater than the predetermined time period.

* * * * *